United States Patent [19]

Matsuura et al.

[11] Patent Number: 4,702,980

[45] Date of Patent: Oct. 27, 1987

[54] CONDUCTIVE SHEET AND ELECTROSTATIC RECORDING MEDIUM FORMED THEREFROM

[75] Inventors: Kazuo Matsuura, Kusatsu; Katuzi Nakahara, Shiga; Kenji Hayashi, Kyoto, all of Japan

[73] Assignee: Toray Industries, Incorporated, Tokyo, Japan

[21] Appl. No.: 872,671

[22] Filed: Jun. 10, 1986

Related U.S. Application Data

[63] Continuation of Ser. No. 636,351, Jul. 31, 1984, abandoned.

[30] Foreign Application Priority Data

Aug. 3, 1983 [JP] Japan ..... 58-141239

[51] Int. Cl.[4] ..... G03G 5/14

[52] U.S. Cl. ..... 430/63; 430/65; 430/69

[58] Field of Search ..... 430/63, 65, 69

[56] References Cited

U.S. PATENT DOCUMENTS 3,907,650 9/1975 Pinsler ..... 430/63

4,416,963 11/1983 Takimoto et al. ..... 430/63

*Primary Examiner*—John L. Goodrow

*Attorney, Agent, or Firm*—Scully, Scott Murphy & Presser

[57] ABSTRACT

Provided is a conductive sheet comprising an organic polymer sheet (A) and a conductive layer, wherein said conductive layer comprises at least one thin metal oxide layer (B) having a thickness within the range of 5 to 1000 Å and at least one metal layer (C) consisting mainly of at least one metal selected from the group consisting of Pt, Pd, Rh, Ru, and Ir, and wherein the surface resistivity of said conductive layer is within the range of $10^4$ to $10^9$ ohm per square.

12 Claims, No Drawings

CONDUCTIVE SHEET AND ELECTROSTATIC RECORDING MEDIUM FORMED THEREFROM

This is a continuation of copending application Ser. No. 636,351, filed on July 31, 1984, now abandoned.

BACKGROUND OF THE INVENTION

This invention relates to a conductive sheet and an electrostatic recording medium formed therefrom.

Known conductive sheets include those prepared from an organic polymer incorporated with a conductive powder such as carbon powder or metal powder, or those formed by applying an inorganic conductive layer of aluminum, silver, gold, tin oxide-indium oxide on the surface of an organic polymer by vacuum deposition or sputtering. Further, electrostatic recording media prepared by forming a dielectric layer on a conductive sheet are also known.

Generally, the surface resistivity required for conductive layers of electrostatic recording media falls within the range of $10^4$ to $10^9$ ohm per square.

To obtain stable image properties, it is believed desirable above all, though it depends on the electrostatic recording system used, that the uniformity, i.e., the dispersion about the median value, of the surface resistivities of a conductive layer be within about ±20%, and that the change with time, i.e., the ratio of the value after the lapse of time to the initial value be within 3 to 5.

However, in these conventional conductive sheets, their surface resistivities depend largely on the amount of a conductive powder added or the amount of an inorganic conductive layer formed, and especially when the surface resistivity of a conductive sheet is within the semiconductor region of $10^4$ to $10^9$ ohm per square, its value changes greatly with even a slight change in the amount of the conductive powder or the inorganic conductive layer. Therefore, there has been a problem that it is difficult to obtain a resistivity which is uniform over a wide area.

Further, a conductive sheet having an inorganic conductive layer on the surface has a problem that when it is exposed to air or water vapor for a long time, or placed in a high-temperature and high-humidity atmosphere, its electric resistance increases greatly.

Therefore, the conventional conductive sheets can not be used in the field where that electrical conductivity is necessary which is uniform and stable and within the semiconductor region of $10^4$ to $10^9$ ohm per square. Therefore, electrostatic recording media prepared by using the conventional conductive sheets have serious obstruction in putting them into practical use because they have problems that because of a great change in the resistance value of a conductive layer, no image which is uniform over a wide area can be obtained, and that when they are exposed to air or water vapor for a long time, or placed in a high-temperature and high-humidity atmosphere, their surface resistance values increase and therefore no stable image properties can be obtained.

SUMMARY OF THE INVENTION

It is an object of this invention to provide a conductive sheet which is free from the abovementioned drawbacks, that is, a conductive sheet which has a surface resistivity which is uniform over a wide area and within the semiconductor region of $10^4$ to $10^9$ ohm per square and is stable and changes little with the lapse of time in an atmosphere of air, water vapor, heat, or the like.

It is another object of this invention to provide an electrostatic recording medium which has image properties which are stable over a wide area and vary little with the lapse of time in an atmosphere of air, water vapor, heat, or the like.

The gist of this invention resides in (1) a conductive sheet comprising an organic polymer sheet (A) and a conductive layer, wherein said conductive layer comprises at least one thin metal oxide layer (B) having a thickness of 5 to 1000 Å and at least one metal layer (C) consisting mainly of at least one metal selected from the group consisting of Pt, Pd, Rh, Ru, and Ir, and wherein the surface resistivity of said conductive layer is $10^4$ to $10^9$ ohm per square; and (2) an electrostatic recording medium prepared by laminating an organic polymer sheet (A), a conductive layer, and a dielectric layer (D) in this sequence, wherein said conductive layer comprises at least one thin metal oxide layer (B) having a thickness of 5 to 1000 Å, and at least one metal layer (C) consisting mainly of at least one metal selected from the group consisting of Pt, Pd, Rh, Ru, and Ir, and wherein the surface resistivity of said conductive layer is $10^4$ to $10^9$ ohm per square.

DETAILED DESCRIPTION OF THE PREFERRED EMBODIMENTS

The organic polymer sheet (A) to be used in this invention is a sheet-like product prepared from polyolefin such as polyethylene or polypropylene; polyester such as polyethylene terephthalate, or polyethylene 2,6-naphthalate; polycarbonate; polyamide; polysulfone; polyphenylene sulfide; polyphenylene oxide; polytetrafluoroethylene; polymethyl methacrylate; polyvinyl chloride; polyvinylidene fluoride; aromatic polyamide; polyamide-imide; polyimide; mixtures thereof; copolymers thereof; and crosslinked products thereof. Above all, biaxially oriented sheets are the most suitable because of their excellence in flatness and dimensional stability.

Though the thickness of the organic polymer sheet is not particularly limited, it is 2 to 500 μm, preferably 10 to 200 μm, most preferably 20 to 150 μm from the viewpoint of flexibility and processability.

The organic polymer sheet is preferred to have a surface resistivity of above $10^{10}$ ohm per square preferably above $10^{12}$ ohm per square, because uniformity in the electric resistance is obtained in forming the thin metal oxide layer and the metal layer. Further, the organic polymer sheet may be one which has been subjected to a pretreatment such as electric corona treatment, glow discharge treatment, anchor coating, or surface-roughening treatment for the purpose of facilitating bonding, imparting abrasion resistance, improving flatness, etc.

The thin metal oxide layer (B) is a thin layer which itself is substantially insulating and comprising titanium oxide, silicon oxide, indium oxide, tin oxide, aluminum oxide, zinc oxide, tantalum oxide, zirconium oxide, tangsten oxide, or mixtures thereof. Among them, titanium oxide, indium oxide, zirconium oxide, tin oxide and tantalum oxide are preferable. The thickness of the metal oxide is in the range of 5 to 1000 Å, preferably 10 to 500 Å, most preferably 10 to 100 Å. When this thickness is as thin as below 5 Å, the effect of uniforming and stabilizing the resistivity of a conductive layer is small while when it exceeds 1000 Å, the stability of the resistivity becomes poor, instead, perhaps because cracks are formed easily due to low flexibility, which are not desirable.

The thin metal oxide layer can be formed by vacuum deposition, sputtering, ion plating, chemical vapor deposition, etc. Above all, reactive sputtering which is performed by using a metallic material as a target at an oxygen partial pressure in the range of $10^{-5}$ to $10^{-2}$ Torr is the most suitable in respect of the uniformity of the thin metal oxide layer. The reactive sputtering process may be of any types including direct-current sputtering and high-frequency sputtering and further may be any of processes such as three-electrode sputtering, four-electrode sputtering, magnetron sputtering and ion beam sputtering.

In case of vacuum deposition or ion plating, heating methods which are applicable include resistance heating, induction heating, electron beam heating, and laser beam heating, among which electron beam heating is suitable because the rate of deposition is high.

Further, the formation of a thin metal oxide layer may be performed by coating. For example, it can be obtained by applying an organic solvent-soluble metallic compound or a water-soluble metal compound to form a thin film and heating this film. These organic solvent-soluble metallic compounds are suitably selected from the alkoxides, acylates, chelates, etc., of said metal and mixtures thereof. These water-soluble metallic compounds are suitably selected from the halides, nitrates, carbonates, etc., of said metal and mixtures thereof.

The metal layer (C) of this invention is a metal layer consisting mainly (preferably, above 95% by weight) of at least one metal selected from the group consisting of Pt, Pd, Rh, Ru, and Ir.

Among them, Pt, Pd, and Rh are particularly preferred because of their uniformity and stability of the surface resistivity. These metals may contain below 5% by weight of other metallic materials, such as copper, silver, gold, iron, tantalum, tungsten, or molybdenum.

The metal layer may be formed by using Pt, Pd, Rh, Ru, Ir, or an alloy or mixture thereof by vacuum deposition, sputtering, ion plating, or the like.

The surface resistivity of the conductive sheet is within the range of $10^4$ to $10^9$ ohm per square, preferably $10^5$ to $10^8$ ohm per square. When this value is below $10^4$ ohm per square, the effect of this invention in improving the uniformity of a resistance value is small, while when it exceeds $10^9$ ohm per square, the effect of improving the stability of a resistance value is small.

With respect to the state of deposition of the metal layer, a layer of island-like fine particles structure is more desirable than a uniform layer in respect of uniformity and stability, probably because of an increased area of contact with the metal oxide thin layer. The average particle size in case of this island-like fine particle structure is preferably within the range of $10^{-5}$ to $10^{-2}$ $\mu m^2$. The area fraction of the island-like fine particles is preferably within the range of 10 to 70%.

The dielectric layer (D) is an insulating resin, alone or in admixture with a filler dispersed therein, though it is not particularly limited thereto so far as the resin and the filler are those usually known. The insulating resins which can be mentioned are thermoplastic resins such as polyester, polyesteramide, polyvinyl acetal, polyvinyl chloride, poly(meth)acrylates, nylon, polyurethane, polycarbonate, polystyrene and copolymers and blends thereof, and thermo-setting resins such as phenolic resin, melamine resin, organosilicone compounds, and epoxy resin, though they are not limited thereto. The preferred fillers include, for example, inorganic fillers such as $SiO_2$, $TiO_2$, MgO, BeO, $Al_2O_3$, $CaCO_3$, $BaTiO_3$, and $ZrO_2$, and and organic fillers such as melamine resin, styrene-divinylbenzene copolymers, phenolic resin, and polyimide, though they are not limited thereto.

The organic polymer sheet (A), the thin metal oxide layer (B), the metal layer (C), and the dielectric layer (D) are laminated in at least the sequence of A/B/C, or A/C/B to form a conductive sheet, which is in turn laminated with the dielectric layer (D) on the side C or B of the sheet to form an electrostatic recording medium. Here, the surface with which D is laminated, that is, the surface C or B must have a surface resistivity within the range of $10^4$ to $10^9$ ohm per square and preferably within the range of $10^5$ to $10^8$ ohm per square.

Here, A/B/C means that intimate bonding is made between the layers A and B and between the layers B and C.

The arrangement of the layers of the conductive sheet of this invention is preferably A/C/B rather than A/B/C, more preferably A/B/C/B. Further, the arrangement of the layers of the electrostatic recording medium is preferably A/C/B/D rather than A/B/C/D, more preferably A/B/C/B/D. Further, if desired, it is possible to provide an adhesive layer in order to improve the bondability between the conductive sheet and the dielectric layer.

The dielectric layer of this invention may be a monolayer or a laminate of a plurality of layers.

In this invention, the adhesive layer and the dielectric layer may be applied by methods usually known and suitably selected from brush coating, dip coating, knife coating, roller coating, spray coating, flow coating, rotational coating (spinner, wheeler etc.) or film lamination.

The functions of this invention will now be described.

The gist of this invention resides in improving the uniformity and stability of the electric resistivity of the metal layer by applying a thin metal oxide layer to at least one surface of the metal layer comprising at least one metal selected from the group consisting of Pt, Pd, Rh, Ru, and Ir. This formation of the metal oxide layer on at least one of the surfaces of the metal layer can present the state of application of the metal layer, especially, the metal comprising island-like fine particles from being changed by heat or a corrosive atmosphere, and further because the surface of the metal layer is covered with the metal oxide layer, oxidation of the metal layer by contact with air or oxygen gas will be prevented. This is an effect which becomes marked especially when the metal layer is one comprising Pt, Pd, Rh, Ru, or Ir.

Namely, in the conductive layer of this invention formed from at least one thin metal oxide layer (B) having a thickness of 5 to 1000 Åand at least one metal layer (C) consisting mainly of at least one metal selected from the group consisting of Pt, Pd, Rh, Ru, and Ir, the layer that directly contributes to the electric conductivity is the metal layer (C), and the thin metal oxide layer (B) is substantially an insulating thin layer.

The effects of this invention will now be described.

The following excellent effects can be obtained in this invention by laminating a specified organic polymer sheet (A), a thin metal oxide layer (B), and a metal layer (C) in the sequence of A/B/C or A/C/B: that the uniformity of the resistivity in the semiconductor region of $10^4$ to $10^9$ ohm per square can be improved markedly, so that the production of a conductive sheet of a large area can be facilitated, that the change in the resistance value in an atmosphere of oxygen, water vapor, high-temperature or high-humidity is lowered markedly, so that a conductive sheet of excellent heat resistance and stability can be obtained, that the uniformity of the resistivity in the semiconductor conductor region of $10^4$ to $10^9$ ohm per square can be improved markedly, so that an electrostatic recording medium which has a large area and which can provide stable images can be obtained, and that the change in the resistance value in an atmosphere of oxygen, water vapor, high-temperature or high-humidity is decreased markedly, so that an electrostatic recording medium having excellent heat resistance, stability, and moisture resistance and a long life can be obtained.

The conductive sheet obtained in this invention may be used alone as an antistatic material, a resistor, or when one of the surfaces of the conductive sheet is coated with an adhesive, dielectrics, photoconductor, or a magnetic substance, it may also be used as an IC packaging material, an electrostatic recoding sheet, an electrophotographic sensitive material, a magnetic recording medium or the like.

The electrostatic recording medium obtained in this invention may be used as (1) a transfer master of a recording system in which a toner image is formed on an electrostatic recording medium, this image is transferred onto plain paper, and then the medium is cleaned for repeated use, such as a duplication machine, a facsimile receiver or printer, in which plain paper is used as hard copying paper and (2) an electrostatic recording film for a recording system in which a toner image is formed on an electrostatic recording medium, and the image is fixed, such as an electrostatic plotter for computer aided design (CAD), or computer aided manufacturing (CAM), or (3) a recording medium for holding a transferred electrostatic image to be used in the transfer of electrostatic image (TESI) process.

The measurements of the properties in this invention are made as follows.

1. Surface resistivity

A conductive sheet is cut to form a 30 mm-wide strip, and two parallel lines which are 30 mm distant from each other and intersect the cut lines at right angles are supposed on the strip. A conductive paste is applied to each of the sections which are on the right and left sides of the section intercepted by the above two lines, and these are used as electrodes. Then, the electric resistance between these electrodes is measured with an electrometer (type 610C, a product of Keithley). The unit is ohm per square. The surface resistivity of an electrostatic recording medium is measured also in a similar manner.

2. Film thickness of metal oxide layer

A conductive sheet is dissolved in aqua regia, and then converted into a solution in dilute hydrochloric acid. This solution is measured by using an ICP emission spectral analyzer (a product of Daini Seikosha Co., Ltd., type SPS-1100) to determine the weight of a metal oxide formed. A film thickness in terms of weight is calculated from the weight of the metal oxide formed and the bulk density.

3. Image properties

A recording-erasing test in which a voltage of +450 V is applied to the surface of the dielectric layer by using the conductive layer as a counter electrode to form an electrostatic image, and thereafter a voltage of −450 V is applied to erase the electrostatic image is repeated many times. Finally, a voltage of +450 V is applied and, after development with a toner, the optical density (OD) of the image is measured by using an optical densitometer (Densitometer, type P-2, a product of Fuji Photo Film Co., Ltd.).

EXAMPLES 1 to 3

A titanium oxide layer (20 Å thick) was formed on each biaxially oriented polyethylene terephthalate film (100 μm thick, 500 mm wide) by a reactive sputtering process.

The sputtering was performed at a pressure of $6\times10^{-4}$ Torr by using metallic titanium (purity of 99.9%, 700 mm wide, 10 mm thick) as a target in a direct-current magnetron sputtering apparatus to which an argon/oxygen gaseous mixture (oxygen 12% by volume) was being fed. Then, a platinum layer having a surface resistivity of $10^5$, $10^6$, or $10^7$ ohm per square was formed on each of the titanium oxide layer by using platinum (purity of 99.9%, 700 mm wide, 2 mm thick) as a target by a sputtering process. The sputtering of these platinum layers was performed at a pressure of $8\times10^{-4}$ Torr by using a direct-current magnetron sputtering apparatus to which argon gas was being fed.

The formed platinum layers having surface resistivities of $10^5$, $10^6$, and $10^7$ ohm per square are referred to as Examples 1, 2, and 3, respectively.

In this way, conductive sheets having a polyethylene terephthalate film as A, titanium oxide as B, and platinum as C arranged in the sequence of A/B/C were obtained.

The surface resistivities of the conductive sheets thus obtained were measured at about 100 pairs of points 5 cm-distant in the longitudinal or lateral direction, and the standard deviation ($\sigma$) of the measured surface resistivities was determined for each sheet. Here, $\sigma$ represents the uniformity of the surface resistivity.

Next, these conductive sheets were stored at 50° C. and 90% RH for 50 days, and their initial surface resistivities ($R_0$) and surface resistivities after the lapse of time ($R_{50}$) were measured to determine the rate of change ($R_{50}/R_0$). The results are shown in Table 1.

EXAMPLES 4 to 6

A titanium oxide layer (20 Å thick) was formed on the platinum layer of each of the conductive sheets obtained in Examples 1 to 3 by reactive sputtering which was performed in the same way as in Examples 1 to 3.

The sheets having surface resistivities of about $10^5$, $10^6$, and $10^7$ ohm per square are referred to as Examples 4, 5 and 6, respectively.

In this way, conductive sheets having a polyethylene terephthalate film as A, titanium oxide as B, and platinum as C in the sequence of A/B/C/B were obtained.

These conductive sheets ere measured for their initial surface resistivities ($R_0$), standard deviations ($\sigma$), and surface resistivities after 50-day storage at 50° C. and 90% RH ($R_{50}$). The results are shown in Table 1.

COMPARATIVE EXAMPLES 1 to 3

A platinum layer having a surface resistivity of $10^5$, $10^6$, or $10^7$ ohm per square was formed on each biaxially oriented polyethylene terephthalate film as used in Examples 1 to 3 by sputtering which was performed in the same way as in Examples 1 to 3.

These platinum layers having surface resistivities of about $10^5$, $10^6$, and $10^7$ ohm per square are referred to as Comparative Examples 1 to 3, respectively.

The conductive sheets in these comparative examples were those in which the layers were arranged in the sequence of A/C.

These conductive sheets were measured for their initial surface resistivities ($R_0$), standard deviations ($\sigma$), and surface resistivities after 50-day storage at 50° C. and 90% RH ($R_{50}$). The results are shown in Table 1.

COMPARATIVE EXAMPLES 4 to 6

A titanium oxide layer (2000 Å thick) was formed on the platinum layer of each of the conductive sheets having surface resistivities of about $10^5$, $10^6$, and $10^7$ ohm per square, obtained in Comparative Examples 1 to 3 by reactive sputtering which was performed in the same manner as in Examples 1 to 3 except that long sputtering time was used.

The conductive sheets in these Comparative Examples were those obtained by arranging the layers in the sequence of A/C/B, and the layer B which was the outermost layer comprised titanium oxide having a thickness of 2000 Å.

Table 1 shows the results of measurements of the initial surface resistivities ($R_0$), standard deviations ($\sigma$), and surface resistivities after 50-day storage at 50° C. and 90% RH ($R_{50}$) of the obtained conductive sheets.

The surface resistivities ($R_0$) were greater by at least one figure than those of the platinum layers themselves, and besides both of the change in the resistivity values along the surface and its change with the lapse of time were marked. The observation of the surfaces of the obtained conductive sheets with an X-ray microanalyzer (SEM-XMA, magnification ×10000) revealed that innumerable fine cracks spaced 0.1 to 1 μm were formed in the titanium oxide layers.

EXAMPLES 7 to 9

A palladium layer having a surface resistivity of about $10^5$, $10^6$ or $10^7$ ohm per square was formed, by sputtering, on each biaxially oriented polyethylene terephthalate film (75 μm thick, 350 mm wide) by using palladium (purity of 99.9%) as a target. The sputtering was performed in argon gas at $8\times10^{-4}$ Torr. Then, an indium oxide-tin oxide layer (50 Å thick) was formed on each of these palladium layers by reactive sputtering which was performed by using an indium-tin alloy (tin: 10% by weight) as a target in a magnetron sputtering apparatus at a pressure of $3\times10^{-3}$ Torr, to which an argon/oxygen gaseous mixture (oxygen 35% by volume) was being fed. These conductive sheets having surface resistivities of $10^5$, $10^6$, and $10^7$ ohm per square are referred to as Examples 7, 8 and 9, respectively.

In this way, conductive sheets having a polyethylene terephthalate film as A, indium oxide-tin oxide as B, and palladium as C in the sequence of A/C/B were obtained. The $R_0$, $\sigma$, and $R_{50}$ of each of these conductive sheets are shown in Table 1.

In the same way as in Examples 7 to 9, an indium oxide-tin oxide layer (50 Å thick) was formed directly on a polyethylene terephthalate film by sputtering to obtain a laminated sheet of the sequence of A/B. The resistivity of the surface B of said laminated sheet was above $10^{10}$ ohm per square. Namely, the thin metal oxide layer B itself of this invention was substantially insulating.

COMPARATIVE EXAMPLE 7

An indium oxide-tin oxide layer was formed on a biaxially oriented polyethylene terephthalate film (125 μm thick) by reactive sputtering which was performed by using an indium-tin alloy (tin: 10% by weight) as a target in a magnetron sputtering apparatus at a pressure of $1\times10^{-3}$ Torr, to which an argon/oxygen gaseous mixture (oxygen: 30% by volume) was being fed. The thus-prepared layer having a surface resistivity of about $10^6$ ohm per square is referred to as Comparative Example 7, and its $R_0$, $\sigma$, and $R_{50}$ are shown in Table 1.

The conductive sheet in this Comparative Example was the one obtained by arranging the layers in the sequence of A/B.

Table 1 clearly shows that the conductive sheets (Examples 1 to 9) of this invention were those which had small standard deviations ($\sigma$) of the surface resistivity, i.e., excellent uniformity and a small rate of change in surface resistivity, i.e., stable surface resistivity as compared with those of Comparative Examples 1 to 7.

TABLE 1

| | $R_0$ (ohm per sq.) | $\sigma$ | $R_{50}/R_0$ |
|---|---|---|---|
| Example 1 | $2.1\times10^5$ | $0.08\times10^5$ | 1.08 |
| 2 | $2.2\times10^6$ | $0.11\times10^6$ | 1.21 |
| 3 | $2.1\times10^7$ | $0.13\times10^7$ | 1.34 |
| Example 4 | $2.2\times10^5$ | $0.08\times10^5$ | 1.02 |
| 5 | $2.3\times10^6$ | $0.10\times10^6$ | 1.11 |
| 6 | $2.3\times10^7$ | $0.11\times10^7$ | 1.24 |
| Comparative 1 | $2.1\times10^5$ | $0.25\times10^5$ | 2.8 |
| Example 2 | $2.3\times10^6$ | $0.35\times10^6$ | 5.6 |
| 3 | $2.1\times10^7$ | $0.48\times10^7$ | 10.3 |
| Comparative 4 | $2.1\times10^6$ | $0.31\times10^6$ | 3.1 |
| Example 5 | $4.3\times10^7$ | $0.44\times10^7$ | 6.4 |
| 6 | above $10^9$ | — | — |
| Example 7 | $2.0\times10^5$ | $0.09\times10^5$ | 1.08 |
| 8 | $2.1\times10^6$ | $0.12\times10^6$ | 1.16 |
| 9 | $2.4\times10^7$ | $0.15\times10^7$ | 1.21 |
| Comparative 7 Example | $3.4\times10^6$ | $0.57\times10^6$ | 1.24 |

EXAMPLES 10 TO 12

A uniform dispersion haing the following composition was applied to each of the conductive sheets obtained in Examples 2, 5 and 8 by means of a doctor knife coater so that the dry content might be 7 g/m2, and then dried and crosslinked by heating to obtain electrostatic recording media (Examples 10 to 12, respectively)(coating width of 300 mm):

| | |
|---|---|
| crosslinkable methacrylate/acrylate copolymer | 100 parts by weight |
| crosslinking agent (polyisocyanate) | 10 parts by weight |
| aluminum oxide (number-average particle diameter of 7 μm) | 30 parts by weight |
| toluene | 300 parts by weight |
| butyl acetate | 300 parts by weight |

In this way, electrostatic recording media having the sequences of A/B/C/D (in Example 10), A/B/C/B/D (in Example 11), and A/C/B/D (in Example 12) were obtained.

These electrostatic recording media were measured for their surface resistivities (a sample was cut into a 300 mm-wide strip, and the resistance between two electrodes placed 300 mm apart ($R_0$, ohm per square) was measured) and their image optical densities ($OD_0$) were measured. After storage at 50° C. and 90% RH for 150 days, these media were measured for their surface resistivities ($R_{150}$) and image optical densities ($OD_0$), and their rates of change ($R_{150}/R_0$, and $OD_{150}/OD_0$) were determined. The results are shown in Table 2. With respect to their images, those formed on the media just after their coating and those formed on the media after storage at 50° C. and 90% RH for 150 days were all good.

Further, when these electrostatic recording media were used as transfer electrostatic recording master films, images obtained after the films had been used repeatedly to form 20000 sheets were as good as those initially produced.

EXAMPLE 13

A uniform dispersion comprising the following composition was applied to the conductive sheet obtained in Example 6 by means of a doctor knife coater so that the dry content might be 6 g/m$^2$, and then dried by heating to obtain an electrostatic recording medium (Example 13)(coating width of 150 mm):

| | |
|---|---|
| linear saturated polyester resin | 100 parts by weight |
| titanium oxide | 20 parts by weight |
| methyl ethyl ketone | 300 parts by weight |
| toluene | 300 parts by weight |

The electrostatic recording medium of Example 13 was the one formed by arranging the layers in the sequence of A/B/C/B/D.

This electrostatic recording medium was measured for its surface resistivity (a sample was cut into a 150 mm length, and the resistance was measured, ohm/150 mm×150 mm, $R_0$) and image optical density ($OD_0$). After storage at 50° C. and 90% RH for 150 days, this medium was measured for its surface resistivity ($R_{150}$) and an image optical density ($OD_{150}$), and their rates of change ($R_{150}/R_0$, and $OD_{150}/OD_0$) were determined. The results are shown in Table 2. With rspect to the images, those formed on the medium just after its coating and those formed on the medium after storage at 50° C. and 90% RH for 150 days were all good.

COMPARATIVE EXAMPLES 8 and 9

Electrostatic recording media (Comparative Examples 8 to 9) were obtained in the same manner as in Example 11 and 12 except that the conductive sheets were replaced with those used in Comparative Examples 2 and 3.

The electrostatic recording media in Comparative Examples 8 and 9 were those formed by arranging the layers in the sequence of A/C/D.

These electrostatic recording media were measured for their surface resistivities ($R_0$), and image optical densities ($OD_0$), and next measured for their surface resistivities ($R_{150}$) after storage at 50° C. and 90% RH for 150 days, and image optical densities ($OD_{150}$), and their rates of change ($R_{150}/R_0$, and $OD_{150}/OD_0$) were determined.

The results are summarized in Table 2. With respect to their images, those formed on the media after storage at 50° C. and 90% RH for 150 days had low image optical densities, and unclear areas in part and were poor as compared with those formed on the media just after coating. Table 2 clearly shows that, as compared with the electrostatic recording media of Comparative Examples 8 and 9, those of the present invention (Examples 10 to 13) had stable surface resistivity, a small change in image optical density (substantially no change), and excellent images.

TABLE 2

| | Measured value after coating | | Rate of change after 50-day storage at 50° C. and 90% RH | |
|---|---|---|---|---|
| | Surface resistivity $R_0$ (ohm per square) | Image optical density $OD_0$ | $R_{150}/R_0$ | $OD_{150}/OD_0$ |
| Example | | | | |
| 10 | $2.2 \times 10^6$ | 1.3 | 1.35 | 1.0 |
| 11 | $2.3 \times 10^6$ | 1.3 | 1.21 | 1.0 |
| 12 | $2.1 \times 10^6$ | 1.3 | 1.24 | 1.0 |
| 13 | $2.3 \times 10^7$ | 1.1 | 1.41 | 1.0 |
| Comp. Ex. 8 | $2.1 \times 10^6$ | 1.3 | 17.1 | 0.7 |
| Comp. Ex. 9 | $1.9 \times 10^7$ | 1.1 | 29.4 | 0.2 |

EXAMPLES 14 to 16

In the same way as in Example 1, a titanium oxide layer (20 Å thick) was formed on each biaxially oriented polyethylene terephthalate film (100 μm thick, 500 mm wide) by reactive sputtering.

Then, a palladium layer having a surface resistivity of about $10^5$, $10^6$, and $10^7$ ohm per square was formed by sputtering on each of the titanium oxide layers by using palladium (purity of 99.9%, 700 mm wide, 2 mm thick) as a target. The sputtering of this palladium layer was performed at a pressure of $8\times10^{-4}$ Torr by using a direct-current magnetron sputtering apparatus to which argon gas was being fed.

The thus-obtained sheets having surface resistivities of $10^5$, $10^6$, and $10^7$ ohm per square are referred to as Examples 14, 15, and 16, respectively.

In this way, conductive sheets having a polyethylene terephthalate film as A, titanium oxide as B and palladium as C in the sequence of A/B/C were obtained.

The obtained conductive sheets were measured in the same way as in Examples 1 to 3 for their initial surface resistivities ($R_0$), standard deviations ($\sigma$), and surface resistivities ($R_{50}$) after 50-day storage at 50° C. and 90% RH. The results are shown in Table 3.

EXAMPLES 17 to 19

A titanium oxide layer (20 Å thick) was formed on the palladium layer of each of the conductive sheets obtained in Example 14 to 16 by performing reactive sputtering in the same way as in Example 1.

The thus-obtained conductive sheets having surface resistivities of about $10^5$, $10^6$, and $10^7$ ohm per square are referred to as Examples 17 to 19, respectively.

In this way, conductive sheets having a polyethylene terephthalate film as A, titanium oxide as B, and palladium as C in the sequence of A/B/C/B were obtained.

These conductive sheets were measured for their initial surface resistivities ($R_0$), standard deviations ($\sigma$), and surface resistivities after 50-day storage at 50° C. and 90% RH ($R_{50}$). The results are shown in Table 3.

Table 3 clearly shown that the conductive sheets of this invention (Examples 14 to 19) were excellent and had small standard deviations ($\sigma$) of the surface resistivities, i.e., excellent uniformity, and a small rate of change in surface resistivities, i.e., stable surface resistivity.

EXAMPLES 20 to 22

Electrostatic recording media (Examples 20 and 21) were obtained in the same manner as in Example 10, except that the conductive sheet used in Example 10 was replaced with those of Examples 15 and 18.

An electrostatic recording medium (Example 22) was obtained in the same way as in Example 12, except that a titanium oxide layer (30 Å thick) was formed instead of the indium oxide-tin oxide layer by reactive sputtering.

These electrostatic recording media were measured in the same manner for their $R_0$, $R_{150}/R_0$, $OD_0$, and $OD_{150}/OD_0$. The results are shown in Table 4. With respect to the images, both of those formed on the media just after coating and those formed on the media after storage at 50° C. and 90% RH for 150 days were all good. Further, images after repeated use of 10,000 times were also good.

EXAMPLES 23 and 24

An electrostatic recording medium (Example 23) having the dielectric layer comprising a laminate of two layers was obtained in the same way as in Example 21, except that a layer (dry thickness of 0.5 μm) comprising a self-crosslinking acrylic emulsion was formed between the conductive sheet and the dielectric layer.

An electrostatic recording medium (Example 24) having the dielectric layer comprising a laminate of two layers was obtained in the same way as in Example 22, except that a layer (dry thickness of 0.5μ) comprising a self-crosslinking acrylic emulsion was formed between the conductive film and the dielectric layer.

These electrostatic recording media were measured in the same manner for their $R_0$, $R_{150}/R_0$, $OD_0$, and $OD_{150}/OD_0$. The results are shown in Table 4. With respect to the images, both of those formed on the media just after coating and those formed on the media after 150 days storage at 50° C. and 90% RH were all good. Further, the images after repeated use of 20,000 times were also good.

Table 4 shows that the electrostatic recording media of this invention (Examples 20 to 24) were excellent and had stable surface resistivities, little change in image optical density (substantially no change) and good images.

TABLE 3

| Example | $R_0$ (ohm per sq.) | $\sigma$ | $R_{50}/R_0$ |
|---|---|---|---|
| 14 | $7.2 \times 10^5$ | $0.09 \times 10^5$ | 1.09 |
| 15 | $7.4 \times 10^6$ | $0.11 \times 10^6$ | 1.22 |

TABLE 3-continued

| Example | $R_0$ (ohm per sq.) | $\sigma$ | $R_{50}/R_0$ |
|---|---|---|---|
| 16 | $3.4 \times 10^7$ | $0.14 \times 10^7$ | 1.33 |
| 17 | $7.4 \times 10^5$ | $0.09 \times 10^5$ | 1.02 |
| 18 | $7.5 \times 10^6$ | $0.11 \times 10^6$ | 1.10 |
| 19 | $3.8 \times 10^7$ | $0.13 \times 10^7$ | 1.23 |

TABLE 4

| | Measured value after coating | | Rate of changes after 150-day storage at 50° C. and 90% RH | |
|---|---|---|---|---|
| | Surface resistivity $R_0$ (ohm per square) | Image optical density $OD_0$ | $R_{150}/R_0$ | $OD_{150}/OD_0$ |
| Example | | | | |
| 20 | $7.1 \times 10^6$ | 1.3 | 1.32 | 1.0 |
| 21 | $7.4 \times 10^6$ | 1.3 | 1.22 | 1.0 |
| 22 | $7.3 \times 10^6$ | 1.3 | 1.21 | 1.0 |
| 23 | $7.4 \times 10^6$ | 1.3 | 1.21 | 1.0 |
| 24 | $7.1 \times 10^6$ | 1.3 | 1.20 | 1.0 |

EXAMPLES 25 and 26

A rhodium layer having a surface resistivity of about $10^6$ ohm per square was formed on each biaxially oriented polyethylene terephthalate film (75 μm thick, 500 mm wide) by a sputtering process performed by using rhodium (purity of 99.9%, 700 mm wide and 2 mm thick) as a target in a direct-current magnetron sputtering apparatus at a pressure of $8 \times 10^{-4}$ Torr to which argon gas was being fed. Next, a titanium oxide layer having a thickness of 20 Å was formed on the rhodium layer by sputtering in the same way as in Example 1. In this way, a conductive sheet (Example 25) having a polyethylene terephthalate film as A, titanium oxide as B, and rhodium as C in the sequence of A/C/B was obtained.

A titanium oxide layer having a thickness of 40 Å was formed on a biaxially oriented polyethylene terephthalate film (100 μm thick, 500 mm wide) by a sputtering process performed in the same way as in Example 1. Then, rhodium and titanium oxide layers (20 Å thick) were formed in this order to obtain a conductive sheet (Example 26) having the sequence of A/B/C/B.

These conductive sheets were measured for their initial surface resistivities ($R_0$), standard deviations ($\sigma$), and surface resistivities after 50-day storage at 50° C. and 90% RH ($R_{50}$). The results are shown in Table 5, which clearly shows that the conductive sheets of this invention (Examples 25 and 26) were excellent and had small standard deviations ($\sigma$), i.e., excellent uniformity, and small rates of change in surface resistivities, i.e., stable surface resistivity.

EXAMPLES 27 and 28

Electrostatic recording media (Examples 27 and 28) each having the dielectric layer which comprised two layers were obtained in the same manner as in Example 23, except that the conductive sheet was replaced with that of Example 25 or 26.

These electrostatic recording media were measured in the same manner for their $R_0$, $R_{150}/R_0$, $OD_0$, and $OD_{150}/OD_0$. The results are shown in Table 6. With respect to their images, both of those formed on the media just after coating, and those formed on the media after 150 days storage at 50° C. and 90% RH were all good. Further, the images after repeated use of 20,000 times were also good. Table 6 shows that the electrostatic recording media (Examples 27 and 28) of this invention were excellent and had stable surface resistivities, little changes (substantially no change) in image optical density, and good images.

EXAMPLE 29

A tantalum oxide layer (20 Å thick) was formed on a biaxially oriented polyethylene terephthalate film (100 μm thick, 500 mm wide) by a reactive sputtering process.

The sputtering was performed at a pressure of $2\times10^{-3}$ Torr by using metallic tantalum (purity 99.9%, 700 mm wide, 3 mm thick) as a target in a direct-current magnetron sputtering apparatus to which an argon-/oxygen gaseous mixture (oxygen: 30% by volume) was being fed. Then, a platinum layer having a surface resistivity of $10^6$ ohm per square was formed according to the same method of Example 1.

On the platinum layer thus formed, tantalum oxide was deposited in the same way as used above. A uniform dispersion having the following composition was applied to the conductive sheet obtained above by means of a doctor knife coater so that the dry content might be 7 g/m$^2$, and then dried and crosslinked by heating to obtain electrostatic recording medium (coating width of 300 mm):

| | |
|---|---|
| crosslinkable methacrylate/acrylate copolymer | 100 parts by weight |
| crosslinking agent (polyisocyanate) | 10 parts by weight |
| aluminum oxide (number-average particle diameter of 7 μm) | 30 parts by weight |
| toluene | 300 parts by weight |
| butyl acetate | 300 parts by weight |

In this way, electrostatic recording medium having the sequence of A/B/C/B/D was obtained. The electrostatic recording medium was measured in the same manner for the $R_0$, $R_{150}/R_0$, $OD_0$ and $OD_{150}/OD_0$. The result is shown in Table 6. With respect to the image, both of that formed on the medium just after coating, and that formed on the medium after 150 days storage at 50° C. and 90% RH were all good. Further, the images after repeated use of 20,000 times were also good. Table 6 shows that the electrostatic recording media (Example 29) of this invention were excellent and had stable surface resistivities, little changes (substantially no change) in image optical density, and good images.

TABLE 5

| Example | $R_0$ (ohm per square) | $\sigma$ | $R_{50}/R_0$ |
|---|---|---|---|
| 25 | $6.5\times10^6$ | $0.11\times10^6$ | 1.21 |
| 26 | $5.8\times10^6$ | $0.10\times10^6$ | 1.09 |

TABLE 6

| | Measured value after coating | | Rate of change after 150-day storage at 50° C. and 90% RH | |
|---|---|---|---|---|
| | Surface resistivities $R_0$ (ohm per square) | Image optical density $OD_0$ | $R_{150}/R_0$ | $OD_{150}/OD_0$ |
| Example 27 | $6.3\times10^6$ | 1.3 | 1.31 | 1.0 |

TABLE 6-continued

| | Measured value after coating | | Rate of change after 150-day storage at 50° C. and 90% RH | |
|---|---|---|---|---|
| | Surface resistivities $R_0$ (ohm per square) | Image optical density $OD_0$ | $R_{150}/R_0$ | $OD_{150}/OD_0$ |
| Example 28 | $5.4\times10^6$ | 1.3 | 1.20 | 1.0 |
| Example 29 | $2.1\times10^6$ | 1.3 | 1.23 | 1.0 |

What is claimed is:

1. An electrostatic recording medium which comprises an organic polymer sheet (A), a conductive layer, said conductive layer comprising at least one thin metal oxide layer (B) having a thickness within the range of 5 to 1,000 A, said metal oxide layer being substantially insulating and at least one discontinuous metal layer (C) consisting essentially of at least one metal selected from the group consisting of Pt, Pd, Rh, and Ir, said discontinuous metal layer comprising an island-like fine particle structure, the average size of said particle being within the range of $10^{-5}$ to $10^{-2}$ μm$^2$, the surface resistivity of said conductive layer being in the range of $10^4$ to $10^9$ ohm per square and a dielectric layer (D), whereupon the electrostatic image is formed, said layers laminated in the layer order (A), (B) (C), (B) and (D) or (A), (C), (B) and (D).

2. The electrostatic recording medium as defined in claim 1, wherein the organic polymer in said organic polymer sheet (A) is biaxially oriented polyethylene terephthalate film.

3. The electrostatic recording medium as defined in claim 1, wherein the metal oxide in said thin metal oxide layer is selected from the group consisting of titanium oxide, indium oxide, zirconium oxide, tin oxide and tantalum oxide.

4. The electrostatic recording medium as defined in claim 1, wherein the thickness of said thin metal oxide layer (B) is within the range of 10 to 500 Å.

5. The electrostatic recording medium as defined in claim 1, wherein the metal in said metal layer (C) is selected from the group consisting of Pt, Pd, and Rh.

6. The electrostatic recording medium as defined in claim 1, wherein the organic polymer in said organic polymer sheet (A) is biaxially oriented polyethylene terephthalate film, and the metal oxide in said thin metal oxide layer (B) is titanium oxide, and the metal in said metal layer (C) is selected from the group consisting of Pt, Pd, and Rh.

7. The electrostatic recording medium as defined in claim 1, wherein said dielectric layer (D) comprises an insulating resin containing a filler dispersed therein.

8. The electrostatic recording medium as defined in claim 1, wherein said dielectric layer (D) comprises a laminate of a plurality of layers.

9. The electrostatic recording medium as defined in claim 1, wherein the insulating resin in said dielectric layer (D) comprises a crosslinked methacrylate/acrylate copolymer.

10. The electrostatic recording medium as defined in claim 1, wherein the surface resistivity of said conductive layer is within the range of $10^5$ to $10^8$ ohm per square.

11. The electrostatic recording medium as defined in claim 1, where in the surface resistivity of said metal oxide layer (B) is above $10^{10}$ ohm per square.

12. The electrostatic recording medium as defined in claim 1, wherein the area fraction of the island-like fine particles of the metal is within the range of 10 to 70%.

* * * * *

UNITED STATES PATENT AND TRADEMARK OFFICE

CERTIFICATE OF CORRECTION

PATENT NO. : 4,702,980

DATED : October 27, 1987

INVENTOR(S) : Kazuo Matsuura, et al.

It is certified that error appears in the above-identified patent and that said Letters Patent is hereby corrected as shown below:

Column 5, line 9: "the semiconductor conductor region" should read as --the semiconductor region--

Column 8, line 51: "haing" should read as --having--

Column 9, line 10: "($OD_o$)" should read as --($OD_{150}$)--

Column 12, line 11: "Rate of changes" should read as --Rate of change--

Column 14, Claim 1, line 19: "Pt, Pd, Rh, and Ir" should read as --Pt, Pd, Rh, Ru and Ir--

Signed and Sealed this

Fourteenth Day of June, 1988

*Attest:*

*Attesting Officer*

DONALD J. QUIGG

*Commissioner of Patents and Trademarks*